US007700169B2

(12) United States Patent
Favre et al.

(10) Patent No.: US 7,700,169 B2
(45) Date of Patent: Apr. 20, 2010

(54) RECORDING SHEET FOR INK JET PRINTING

(75) Inventors: Pierre Favre, Marly (CH); Martin Staiger, Westerstetten (DE)

(73) Assignee: Ilford Imaging Switzerland GmbH (CH)

( * ) Notice: Subject to any disclaimer, the term of this patent is extended or adjusted under 35 U.S.C. 154(b) by 996 days.

(21) Appl. No.: 11/440,980

(22) Filed: May 25, 2006

(65) Prior Publication Data

US 2006/0268088 A1 Nov. 30, 2006

(30) Foreign Application Priority Data

May 25, 2005 (EP) ..... 05104489

(51) Int. Cl.
*B41M 5/50* (2006.01)

(52) U.S. Cl. ..... 428/32.18; 428/32.36

(58) Field of Classification Search ..... None
See application file for complete search history.

(56) References Cited

U.S. PATENT DOCUMENTS

| | | | |
|---|---|---|---|
| 6,773,771 | B1 | 8/2004 | Ashida et al. |
| 2003/0194512 | A1 | 10/2003 | Endo et al. |
| 2004/0025746 | A1 | 2/2004 | Batz-Sohn et al. |
| 2006/0078696 | A1 | 4/2006 | Furholz et al. |

FOREIGN PATENT DOCUMENTS

| | | | |
|---|---|---|---|
| DE | 100 20 346 | A1 | 11/2000 |
| EP | 0 559 324 | A1 | 9/1993 |
| EP | 0 586 846 | A1 | 3/1994 |
| EP | 1 120 281 | A1 | 8/2001 |
| EP | 1 452 328 | A1 | 9/2004 |
| EP | 1 655 348 | A1 | 5/2006 |
| WO | WO 00/20221 | | 4/2000 |
| WO | WO 02/094573 | A1 | 11/2002 |

OTHER PUBLICATIONS

R. Hofmann, E. Baumann and M. Schäer, "Print Performance Evaluation of Ink-jet Media: Gamut, Drying, Permanence," IS&Ts NIP 15: International Conference on Digital Printing Technologies, 1999, ISBN 0-89208-222-4.

ANSI IT9.10-1991 "Determination of the Curl of Photographic Films".

Technical Data Sheet of Mowiol® from Kuraray Specialities Europe, published Oct. 2002.

Data Sheet of CAB-O-SIL® M-5 from Cabot Corporation, published Nov. 2002.

IUCLID Dataset for dialuminium chloride pentahydrate 2000 European Commission, European Chemicals Bureau, created Feb. 18, 2000.

IUCLID Dataset for N-(3-(trimethoxysilyl)propyl)ethylenediamine Epona Associates, LLC created Jun. 16, 2003, printed Oct. 26, 2004.

*Primary Examiner*—Bruce H. Hess
(74) *Attorney, Agent, or Firm*—Onofrio Law; Dara L. Onofrio, Esq.

(57) ABSTRACT

A recording sheet for ink jet printing is described, which consists of a paper support having coated on the front side of the support at least one ink-receiving layer consisting of fumed silicon dioxide with a positively charged surface and at least one binder, wherein at least one polyolefin layer is coated at the back side of said support and where there is no polyolefin layer between said paper support and the ink-receiving layer. Preferred is a recording sheet, wherein the surface of the fumed silicon dioxide has been modified by a treatment with the reaction products of a compound of trivalent aluminum with at least one aminoorganosilane.

10 Claims, No Drawings

RECORDING SHEET FOR INK JET PRINTING

FIELD OF THE INVENTION

The present invention relates to a recording sheet for ink jet printing, wherein at least one ink-receiving layer consisting of nanoporous fumed silicon dioxide having a positively charged surface and at least one binder is coated onto the front side of a porous support, and where a polyolefin layer is coated on the backside of said recording sheet.

BACKGROUND OF THE INVENTION

Ink jet printing processes are mainly of two types: continuous stream and non-continuous stream.

In continuous stream ink jet printing, a continuous ink stream is emitted under pressure through a nozzle. The stream breaks up into droplets at a certain distance from the nozzle. If a specific location on the recording sheet has to be printed the individual droplets are directed to the recording sheet, otherwise they are directed to a collecting vessel. This is done for example by charging unnecessary droplets in accordance with digital data signals and passing them through a static electric field which adjusts the trajectory of these droplets in order to direct them to the collecting vessel. The inverse procedure may also be used wherein uncharged droplets are collected in the collecting vessel.

In the non-continuous process, or the so-called "drop-on-demand" process, a droplet is generated and expelled from the nozzle in accordance with digital data signals only in the case where a specific location on the recording sheet has to be printed.

The printing speed of modern ink jet printers is ever increasing for economic reasons. Recording sheets suitable for these printers therefore need to absorb the inks very quickly. Especially suitable are recording sheets containing nanocrystalline, nanoporous inorganic compounds, preferably oxides such as aluminum oxides or silicon dioxide, or oxide/hydroxides such as aluminum oxide/hydroxides. Such recording sheets are known as "nanoporous" recording sheets. For economic reasons, nanoporous recording sheets containing fumed silicon dioxide with a positively charged surface as nanoporous inorganic oxide are particularly preferred.

Nanoporous recording sheets absorb the inks very rapidly (in the microsecond range) by the action of the capillary forces of the nanoporous compounds. Polymer based recording sheets absorb the inks more slowly (in the millisecond range) by swelling of the polymer. Recording sheets on porous paper supports absorb the inks at comparable speeds by swelling of the paper felt.

For economic reasons, it would be desirable that also in the case of high, but not highest quality ink jet printing, cheaper paper supports than paper supports with a polyolefin layer on both sides could be used without a significant quality loss. Such recording sheets would have a slightly lower gloss than the corresponding recording sheets on paper supports with a polyolefin layer on both sides, but they would nevertheless have suitable properties in many fields of application.

Patent application DE 10,020,346 describes a recording sheet for ink jet printing, which contains silicon dioxide with a size of the primary particles of at most 20 nm prepared in the gas phase, wherein the surface of the silicon dioxide has been positively charged by a treatment with polyaluminum hydroxychloride.

Patent application WO 00/20,221 describes a recording sheet for ink jet printing, wherein the ink-receiving layer contains silicon dioxide prepared in the gas phase and wherein the surface of the silicon dioxide has been modified by a treatment with aluminum chlorohydrate. This surface is positively charged.

Patent application WO 02/094,573 describes a recording sheet for ink jet printing, wherein the ink-receiving layer contains silicon dioxide prepared in the gas phase and wherein the surface of the silicon dioxide has been modified by a treatment with aminoorganosilanes. This surface is also positively charged.

Patent application EP 1,655,348 describes a recording sheet for ink jet printing, wherein the ink-receiving layer contains silicon dioxide prepared in the gas phase and wherein the surface of the silicon dioxide has been modified by a treatment with the reaction products of a compound of trivalent aluminum with at least one aminoorganosilane. This surface is also positively charged.

SUMMARY OF THE INVENTION

An objective of the invention is to provide nanoporous recording sheets with a reduced thickness of the ink-receiving layer showing good flatness.

A further objective of the invention is to provide such nanoporous recording sheets with lowered dye diffusion and improved coalescence (no formation of ink puddles during printing).

We have now surprisingly found that these improvements may be obtained when a paper support having coated a polyolefin layer only on its backside is used.

Such a recording sheet according to the invention consists of a porous paper support having coated on its front side at least one ink-receiving layer consisting of nanoporous fumed silicon dioxide with a positively charged surface and at least one binder and having coated on its backside a polyolefin layer.

DETAILED DESCRIPTION OF THE INVENTION

We have surprisingly found that a nanoporous recording sheet for ink jet printing, consisting of a porous paper support and having coated on the front side of said porous paper support at least one ink-receiving layer containing nanoporous fumed silicon dioxide with a positively charged surface and at least one binder, and having coated on its backside a polyolefin layer, shows considerably better flatness in comparison to a corresponding recording sheet wherein the porous paper support has no polyolefin layer on its backside.

Surprisingly, we have also found that the thickness of the ink-receiving layer on the front side of such a support having coated a polyolefin layer on its backside may be reduced considerably and that the recording sheet according to the invention still has the necessary high ink absorption speed and the necessary high ink absorption capacity. Dye diffusion is also considerably improved in these recording sheets according to the invention.

The porous paper support with a polyolefin layer on the backside does not have a polyolefin layer nor a subbing layer underneath the ink-receiving layer on its front side, but it has a thin layer of calcium carbonate on its front side, preferably together with a binder. Starch is the preferred binder.

The felt of the paper support has a thickness between 100 μm and 250 μm. A thickness between 150 μm and 200 μm is preferred for the recording sheets according to the invention.

On the backside of the paper support, one or more polyolefin layers having different compositions may be arranged. Polyolefins having different properties may be used.

Mixtures of high-density polyethylene (HDPE) and low-density polyethylene (LDPE) are preferred.

Low-density polyethylene has a softening point at temperatures between about 130° C. and about 170° C. and a density of 0.92 g/cm$^3$. It is soft and very flexible.

High-density polyethylene has a softening point at temperatures between about 110° C. and about 140° C. and a density of about 0.94 g/cm$^3$ to maximally 0.97 g/cm$^3$. It is stiffer and more resistant to abrasion than LDPE.

The backing layer may consist of pure HDPE, of a mixture of HDPE and LDPE or of pure LDPE.

Backing layers containing at least 20 percent by weight of LDPE are preferred.

The coating weight of polyethylene is preferably situated in a range between 5 g/cm$^3$ and 30 g/cm$^3$. A range between 7 g/cm$^3$ and 25 g/cm$^3$ is particularly preferred.

The dispersions of surface modified fumed silicon dioxide may be prepared according to the indications given in the above-mentioned patent applications DE 10,020,346, WO 00/20,221 and WO 02/094,573. The surface of the fumed silicon dioxide may be modified by a treatment with a compound of trivalent aluminum, preferably aluminum chlorohydrate, or with an aminoorganosilane.

Preferred are dispersions of surface modified fumed silicon dioxide obtained by a modification with the reaction products of a compound of trivalent aluminum with at least one aminoorganosilane, as described in patent application EP 1,655,348.

In this method, fumed silicon dioxide is added at high shear rates to a mainly aqueous solution containing the reaction products of a compound of trivalent aluminum (such as aluminum chlorohydrate) with at least one aminoorganosilane. Under suitable conditions, a dispersion of surface modified fumed silicon dioxide is obtained that does not coagulate. The mixture containing the reaction products of a compound of trivalent aluminum (such as aluminum chlorohydrate) with at least one aminoorganosilane shows a high buffer capacity. The alkaline aminoorganosilane neutralizes the hydrochloric acid generated during the hydrolysis of the compound of trivalent aluminum (such as aluminum chlorohydrate). The required amount of the compound of trivalent aluminum (such as aluminum chlorohydrate) for the surface modification of silicon dioxide is much lower in this method in comparison to the modification step with aluminum chlorohydrate. These surface modified dispersions of fumed silicon dioxide have a much lower salt content in comparison to dispersions where the surface has been modified with aluminum chlorohydrate.

Deionised water is preferably used for the preparation of the mainly aqueous solutions. Water-miscible solvents such as lower alcohols (methanol, ethanol, propanol and the like) or ketones such as acetone may be added.

The reaction products, used in the modification step, of a compound of trivalent aluminum (such as aluminum chlorohydrate) with at least one aminoorganosilane may be prepared by the addition of the aminoorganosilane to an aqueous solution of the compound of trivalent aluminum (such as aluminum chlorohydrate) or vice versa. The reaction of the compound of trivalent aluminum with the aminoorganosilane is carried out at temperatures from 10° C. to 50° C. for 5 minutes to 60 minutes. The reaction is preferably carried out at room temperature for 10 minutes to 15 minutes.

During the reaction of the two starting compounds, Si—O—Al linkages are formed as could be shown by $^{27}$Al nuclear magnetic resonance spectroscopy. New peaks at 50 ppm to 70 ppm, characteristic for Si—O—Al linkages, appear in the nuclear magnetic resonance spectrum. Their intensity increases with the amount of the aminoorganosilane. The reaction ends after about 10 minutes at room temperature according to the nuclear magnetic resonance measurements.

For the preparation of the surface modified fumed silicon dioxide, the reaction products of a compound of trivalent aluminum (such as aluminum chlorohydrate) with at least one aminoorganosilane may also be added, for example, to an aqueous dispersion of fumed silicon dioxide.

The dispersion of the surface modified fumed silicon dioxide is advantageously used directly for the preparation of the coating solution of the ink-receiving layer of the recording sheet for ink jet printing according to the invention.

The nanoporous recording sheets according to the invention contain at least one binder in the ink-receiving layer.

The binders are in most cases water-soluble polymers. Especially preferred are film-forming polymers.

The water-soluble polymers include for example natural polymers or modified products thereof such as albumin, gelatin, casein, starch, gum arabic, sodium or potassium alginate, hydroxyethyl cellulose, carboxymethyl cellulose, α-, β- or γ-cyclodextrine and the like. In the case where one of the water-soluble polymers is gelatin, all known types of gelatin may be used as for example acid pigskin or limed bone gelatin, acid or base hydrolyzed gelatin, but also derivatized gelatins like for instance phthalaoylated, acetylated or carbamoylated gelatin or gelatin derivatised with the anhydride of trimellitic acid.

Synthetic binders may also be used and include for example polyvinyl alcohol, polyvinyl pyrrolidone, completely or partially saponified products of copolymers of vinyl acetate with other monomers; homopolymers or copolymers of unsaturated carboxylic acids such as maleic acid, (meth)acrylic acid or crotonic acid and the like; homopolymers or copolymers of sulfonated vinyl monomers such as vinylsulfonic acid, styrene sulfonic acid and the like. Furthermore homopolymers or copolymers of vinyl monomers of (meth)acrylamide; homopolymers or copolymers of other monomers with ethylene oxide; polyurethanes; polyacrylamides; water-soluble nylon type polymers; polyesters; polyvinyl lactams; acrylamide polymers; substituted polyvinyl alcohol; polyvinyl acetals; polymers of alkyl and sulfoalkyl acrylates and methacrylates; hydrolyzed polyvinyl acetates; polyamides; polyvinyl pyridines; polyacrylic acid; copolymers with maleic anhydride; polyalkylene oxides; copolymers with methacrylamide and copolymers with maleic acid may be used. All these polymers may also be used as mixtures.

A preferred synthetic binder is polyvinyl alcohol. The hydrolysis degree of the polyvinyl alcohol is preferably between 85% and 100% and its molecular mass between 14,000 and 205,000. Mixtures of polyvinyl alcohols of different hydrolysis degrees and/or different molecular masses may also be used.

These polymers may be blended with water insoluble natural or synthetic high molecular weight compounds, particularly with acrylate latices or with styrene acrylate latices.

Although not specifically claimed in this invention, water insoluble polymers should nevertheless be considered part of the system.

The polymers mentioned above having groups with the possibility to react with a cross-linking agent may be cross-linked or hardened to form essentially water insoluble layers. Such cross-linking bonds may be either covalent or ionic.

Cross-linking or hardening of the layers allows for the modification of the physical properties of the layers, like for instance their liquid absorption capacity or their resistance against layer damage.

The cross-linking agents or hardeners are selected depending on the type of the water-soluble polymers to be cross-linked.

Organic cross-linking agents and hardeners include for example aldehydes (such as formaldehyde, glyoxal or glutaraldehyde), N-methylol compounds (such as dimethylol urea or methylol dimethylhydantoin), dioxanes (such as 2,3-dihydroxydioxane), reactive vinyl compounds (such as 1,3,5-trisacrylolyl hexahydro-s-triazine or bis-(vinylsulfonyl) ethyl ether), reactive halogen compounds (such as 2,4-dichloro-6-hydroxy-s-triazine); epoxides; aziridines; carbamoyl pyridinium compounds or mixtures of two or more of the above mentioned cross-linking agents.

Inorganic cross-linking agents or hardeners include for example chromium alum, aluminum alum or, preferably, boric acid.

The layers may also contain reactive substances that cross-link the layers under the influence of ultraviolet light, electron beams, X-rays or heat.

The layers may further be modified by the addition of fillers. Possible fillers are for instance kaolin, Ca- or Ba-carbonates, silicon dioxide, titanium dioxide, bentonites, zeolites, aluminum silicate or calcium silicate. Organic inert particles such as polymer beads may also be used. These beads may consist of polyacrylates, polyacrylamides, polystyrene or different copolymers of acrylates and styrene. The fillers are selected according to the intended use of the printed images. Some of these compounds cannot be used if the printed images are to be used as transparencies. However they are of interest in cases where the printed images are be to used as remission pictures. Very often, the introduction of such fillers causes a wanted matte surface.

The recording sheets according to the invention comprise a support having coated thereon at least one ink-receiving layer, and, optionally, auxiliary layers.

The ink-receiving layers are in general coated from aqueous solutions or dispersions containing all necessary ingredients. In many cases, wetting agents are added to those coating solutions in order to improve the coating behavior and the evenness of the layers. Besides being necessary for coating purposes, these compounds may have an influence on the image quality and may therefore be selected with this specific objective in mind. Although not specifically claimed in this invention, wetting agents nevertheless form an important part of the invention.

In addition to the above mentioned ingredients, recording sheets according to the invention may contain additional compounds aimed at further improving their performance, as for example brightening agents to improve the whiteness, such as stilbenes, coumarines, triazines, oxazoles or others compounds known to someone skilled in the art.

Light stability may be improved by adding UV absorbers such as 2-hydroxybenzotriazoles, 2-hydroxybenzophenones, derivatives of triazine or derivatives of cinnamic acid. The amount of UV absorber may vary from 200 mg/m$^2$ to 2000 mg/m$^2$, preferably from 400 mg/m$^2$ to 1000 mg/m$^2$. The UV absorber may be added to any of the layers of the recording sheet according to the invention. It is preferred that, however, if it is added, it should be added to the topmost layer.

It is further known that images produced by ink jet printing may be protected from degradation by the addition of radical scavengers, stabilizers, reducing agents and antioxidants. Examples of such compounds are sterically hindered phenols, sterically hindered amines, chromanols, ascorbic acid, phosphinic acids and their derivatives, sulfur containing compounds such as sulfides, mercaptans, thiocyanates, thioamides or thioureas.

The above-mentioned compounds may be added to the coating solutions as aqueous solutions. In the case where these compounds are not sufficiently water-soluble, they may be incorporated into the coating solutions by other common techniques known in the art. The compounds may, for example, be dissolved in a water-miscible solvent such as lower alcohols, glycols, ketones, esters, or amides. Alternatively, the compounds may be added to the coating solutions as fine dispersions, as oil emulsions, as cyclodextrine inclusion compounds or incorporated into latex particles.

Typically, the ink-receiving layer of the recording sheet according to the invention has a thickness in the range of 0.5 μm to 100 μm dry thickness, preferably in the range of 10 μm to 25 μm dry thickness.

The coating solutions may be coated onto the support by any number of suitable procedures. Usual coating methods include for example extrusion coating, air knife coating, doctor blade coating, cascade coating and curtain coating. The coating solutions may also be applied using spray techniques. The ink-receiving layers may be built up from several individual layers that can be coated one after the other or simultaneously.

The selected coating procedure does not however limit the invention in any way.

Inks for ink jet printing consist in essence of a liquid vehicle and a dye or pigment dissolved or suspended therein. The liquid vehicle for ink jet inks consists in general of water or a mixture of water and a water-miscible organic solvent such as ethylene glycol, higher molecular weight glycols, glycerol, dipropylene glycol, polyethylene glycol, amides, polyvinyl pyrrolidone, N-methylpyrrolidone, cyclohexyl pyrrolidone, carboxylic acids and their esters, ethers, alcohols, organic sulfoxides, sulfolane, dimethylformamide, dimethylsulfoxide, cellosolve, polyurethanes, acrylates and the like.

The non-aqueous parts of the ink generally serve as humefactants, cosolvents, viscosity regulating agents, ink penetration agents or drying accelerators. The organic compounds have in most cases a boiling point which is higher than that of water. The dyes and pigments suitable for the preparation of inks useable with the recording sheets according to the invention cover practically all classes of known coloring compounds. Dyes or pigments typically used for this purpose are described in patent application EP 0,559,324. The recording sheets according to the invention are meant to be used in conjunction with most of the inks representing the state of the art.

The inks may further contain other additives such as surfactants, optical brighteners, UV absorbers, light stabilizers, biocides, precipitating agents such as multivalent metal compounds and polymeric additives.

This description of inks is for illustration only and is not to be considered as limiting for the purpose of the invention.

The present invention will be illustrated in more detail by the following examples without limiting the scope of the invention in any way.

Test Methods

1. Flatness

The flatness of the recording sheets according to the invention was determined according to an ANSI (American National Standard Institute) test procedure (ANSI IT9.10-1991, Test Method C, page 3, 1991). Sheets of size A4 of the recording sheet according to the invention were conditioned for 24 hours under the conditions of temperature and humidity as defined in the ANSI test procedure. Afterwards, the sheets were placed with the concave side upwards on a flat surface. The distances between the four corners of the recording sheet and the flat surface were measured. The values indicated in the tables are an average of these four measurements. Deviations from flatness towards the ink-receiving layer have a positive mathematical sign and are characterized as positive edge lift curl. Deviations from flatness away from the ink-receiving layer have a negative mathematical sign and are characterized as negative edge lift curl.

2. Dye Diffusion

The method used is essentially described by R. Hofmann, E. Baumann and M. Schär in "Print Performance Evaluation of Ink-jet Media: Gamut, Drying, Permanence", IS&Ts NIP 15: International Conference on Digital Printing Technologies, ISBN 0-89208-222-4, pages 408-411.

Patches of the colors yellow, red, magenta, blue, cyan, green and black at 100% print density were printed onto the recording sheets according to the invention with the ink jet printers HP 970 and Epson 890 using the corresponding original inks. The printed color patches have an edge length of 118 pixels. Each individual color patch is divided by 11 horizontal and 11 vertical white lines into 144 individual colored squares having an edge length of 8 pixels. The white lines have a width of 2 pixels. The following printer settings were used:

HP 970: HP Premium High Glossy Film, Best

Epson 890: Photo Paper Pro, High, Manual, Graphic, Normal

The printed recording sheets were dried for 24 hours at a temperature of 23° C. at a relative humidity of 50%. Then, the optical densities of the color patches were measured. Afterwards, the printed recording sheets were stored for 7 days at a temperature of 40° C. and at relative humidity of 80%. Finally, the optical densities were re-measured.

The value of dye diffusion is the percent difference of the optical densities of the patch of highest density before and after storage.

3. Coalescence

Coalescence is the expression for the formation of ink puddles during printing.

The recording sheets according to the invention were conditioned for 15 hours at a temperature of 22° C. and a relative humidity of 70%. Afterwards, 39 color patches were printed with the ink jet printer Epson 750 using the corresponding original inks. The color patches consist of the colors cyan, yellow and magenta with a stepwise admixture of the other two colors. The following printer setting was used:

Epson 750: Photo Paper 720 dpi, No Color Adjustment

The compositions of the 39 color patches are indicated in Table 1.

TABLE 1

| | | |
|---|---|---|
| 100% Cyan | 100% Magenta | 100% Yellow |
| 60% Magenta, 60% Yellow | 60% Cyan, 60% Yellow | 60% Cyan, 60% Magenta |
| 100% Cyan | 100% Magenta | 100% Yellow |
| 55% Magenta, 55% Yellow | 55% Cyan, 55% Yellow | 55% Cyan, 55% Magenta |
| 100% Cyan | 100% Magenta | 100% Yellow |
| 50% Magenta, 50% Yellow | 50% Cyan, 50% Yellow | 50% Cyan, 50% Magenta |
| 100% Cyan | 100% Magenta | 100% Yellow |
| 45% Magenta, 45% Yellow | 45% Cyan, 45% Yellow | 45% Cyan, 45% Magenta |
| 100% Cyan | 100% Magenta | 100% Yellow |
| 40% Magenta, 40% Yellow | 40% Cyan, 40% Yellow | 40% Cyan, 40% Magenta |
| 100% Cyan | 100% Magenta | 100% Yellow |
| 35% Magenta, 35% Yellow | 35% Cyan, 35% Yellow | 35% Cyan, 35% Magenta |
| 100% Cyan | 100% Magenta | 100% Yellow |
| 30% Magenta, 30% Yellow | 30% Cyan, 30% Yellow | 30% Cyan, 30% Magenta |
| 100% Cyan | 100% Magenta | 100% Yellow |
| 25% Magenta, 25% Yellow | 25% Cyan, 25% Yellow | 25% Cyan, 25% Magenta |
| 100% Cyan | 100% Magenta | 100% Yellow |
| 20% Magenta, 20% Yellow | 20% Cyan, 20% Yellow | 20% Cyan, 20% Magenta |
| 90% Cyan | 90% Magenta | 90% Yellow |
| 20% Magenta, 20% Yellow | 20% Cyan, 20% Yellow | 20% Cyan, 20% Magenta |
| 80% Cyan | 80% Magenta | 80% Yellow |
| 20% Magenta, 20% Yellow | 20% Cyan, 20% Yellow | 20% Cyan, 20% Magenta |
| 70% Cyan | 70% Magenta | 70% Yellow |
| 20% Magenta, 20% Yellow | 20% Cyan, 20% Yellow | 20% Cyan, 20% Magenta |
| 100% Cyan | 100% Magenta | 100% Yellow |

Afterwards, the number of patches showing coalescence was counted. The smaller their number, the higher is the ink absorption capacity of the recording sheet.

EXAMPLES

Examples 1-4

Preparation of the Dispersion 8.8 g of aluminum chlorohydrate (Locron P, available from Clariant AG, Muttenz, Switzerland) were dissolved at a temperature of 20° C. in 782 g of deionised water and 8.8 g of N-(2-aminoethyl)-3-aminopropyltrimethoxysilane (available from Degussa, Düsseldorf, Germany) were added under vigorous stirring. After a reaction time of 15 minutes (formation of the reaction products from aluminum chlorohydrate with the aminoorganosilane), 200 g of fumed silicon dioxide (Cab-O-Sil® M-5, available from Cabot Corporation, Billerica, USA) were added in small amounts under vigorous stirring at high shear rates. Then, the dispersion was stirred with a rotor-stator-mixer for 15 minutes. Afterwards, the dispersion was heated to a temperature of 60° C. and kept for one hour at this temperature in order to modify the surface of the silicon dioxide.

Preparation of the Coating Solution 4.8 g of solid boric acid were added at a temperature of 45° C. to 600 g of this dispersion. After the dissolution of the boric acid, 300 g of an aqueous solution of polyvinyl alcohol (10%, available as Mowiol 4088 from Clariant AG, Muttenz, Switzerland) were added and afterwards 0.8 g of an aqueous solution of the wetting agent Olin 10G (5.23%, available from Arch Chemicals, Norwalk, USA). At the end, the coating solution was diluted with deionised water to a final weight of 1000 g.

Coatings 108 g/m$^2$ of this coating solution were coated at a temperature of 40° C. with a bar coater onto a paper support having a felt thickness of 190 μm. The backside of the paper support had a polyethylene (mixture of LDPE and HDPE) layer. The support coated with the ink-receiving layer was then dried for 60 minutes at a temperature of 35° C. 1 m$^2$ of the coated support contains 13 g of non-modified fumed silicon dioxide.

The polyethylene quantities on the backside of the paper support are indicated in Table 2:

TABLE 2

| Example | HDPE (g/m$^2$) | LDPE (g/m$^2$) |
|---|---|---|
| 1 | 15 | 5 |
| 2 | 10 | 10 |
| 3 | 5 | 15 |
| 4 | 0 | 20 |

Example 5

Preparation of the Dispersion 200 g of fumed silicon dioxide Cab-O-Sil® M-5 were added in small amounts under vigorous stirring at high shear rates at a temperature of 20° C. to a mixture of 764 g of deionised water, 33.8 g of aluminum chlorohydrate Locron P and 2.0 g of potassium hydroxide. Then, the dispersion was stirred with a rotor-stator-mixer for 15 minutes. Afterwards, the dispersion was heated to a temperature of 60° C. and kept for 3 hours at this temperature in order to modify the surface of the silicon dioxide.

Preparation of the Coating Solution 4.8 g of solid boric acid were added at a temperature of 45° C. to 600 g of this dispersion. After the dissolution of the boric acid, 300 g of an aqueous solution of polyvinyl alcohol Mowiol 4088 (10%) were added and afterwards 0.8 g of an aqueous solution of the wetting agent Olin 10G (5.23%) At the end, the coating solution was diluted with deionised water to a final weight of 1000 g.

Coating 108 g/m$^2$ of this coating solution were coated at a temperature of 40° C. with a bar coater onto a paper support having a felt thickness of 190 μm. The backside of the paper support had a polyethylene (mixture of LDPE and HDPE) layer. The support coated with the ink-receiving layer was then dried for 60 minutes at a temperature of 35° C. 1 m$^2$ of the coated support contains 13 g of non-modified fumed silicon dioxide.

Comparative Example C-1

108 g/m$^2$ of the coating solution of examples 1-4 were coated at a temperature of 40° C. with a bar coater onto a paper support having a felt thickness of 190 μm. The backside of the paper support did not have a polyethylene layer. The support coated with the ink-receiving layer was then dried for 60 minutes at a temperature of 35° C. 1 m$^2$ of the coated support contains 13 g of non-modified fumed silicon dioxide.

Comparative Example C-2

158 g/m$^2$ of the coating solution of examples 1-4 were coated at a temperature of 40° C. with a bar coater onto a paper support having a felt thickness of 190 μm. The paper support had a polyethylene layer on both sides. The support coated with the ink-receiving layer was then dried for 60 minutes at a temperature of 35° C. 1 m$^2$ of the coated support contains 19 g of non-modified fumed silicon dioxide.

Comparative Example C-3

This comparative example corresponds to comparative example C-2 with the difference that the amount of the coating solution was reduced from 158 g/m$^2$ to 108 g/m$^2$. 1 m$^2$ of the coated support contains 13 g of non-modified fumed silicon dioxide.

Results

Flatness

The measured values of edge lift curl at a temperature of 20° C. are indicated in Table 3.

TABLE 3

| | Edge Lift Curl (mm) | |
|---|---|---|
| Example | 20% relative humidity | 70% relative humidity |
| 1 | 7 | 2 |
| 2 | 15 | 6 |
| 3 | 25 | 16 |
| 4 | 25 | 20 |
| C-1 | 59 | >80 |

A comparison of the results in Table 3 immediately shows that the recording sheets for ink jet printing according to the invention with a polyethylene layer on the backside (examples 1-4) show an improved flatness in comparison to a recording sheet without a polyethylene layer on the backside (comparative example C-1).

At constant polyethylene coating weight on the backside, the flatness is improved by increasing the amount of HDPE.

Dye Diffusion

The measured values of dye diffusion are indicated in Table 4.

TABLE 4

| | Dye Diffusion (%) | |
|---|---|---|
| Example | HP 970 | Epson 890 |
| 1 | 39.7 | 7.0 |
| C-3 | 55.1 | 17.6 |
| 5 | 46.4 | 9.0 |
| ILFORD Smooth Gloss | 71.8 | 56.6 |
| Mitsubishi SG 2575 | 61.1 | 45.0 |

The results in Table 4 show that the recording sheet for ink jet printing according to the invention (example 1), shows considerably reduced dye diffusion in comparison to a recording sheet on a non-porous paper support with polyethylene layers on both sides (comparative example C-3) despite the fact that comparative example C-3 has a considerably thicker ink-receiving layer than the recording sheet according to the invention. The surface of the fumed silicon dioxide had been modified by a treatment with the reaction products of the aluminum salt Locron P and the aminoorganosilane N-(2-aminoethyl)-3-aminopropyltrimethoxysilane.

The results in Table 4 further show that the recording sheet for ink jet printing according to the invention (example 1), wherein the surface of the fumed silicon dioxide had been modified with the reaction products of the aluminum salt Locron P and the aminoorganosilane N-(2-aminoethyl)-3-aminopropyltrimethoxysilane (example 1), shows considerably reduced dye diffusion on the paper support with a polyethylene layer only on the backside in comparison to the corresponding recording sheet, wherein the surface of the fumed silicon dioxide had been modified by a treatment with the aluminum salt Locron P (example 5).

The recording sheets according to the invention show also a considerably reduced dye diffusion in comparison to the two commercially available recording sheets ILFORD Smooth Gloss (containing colloidal aluminum oxide/hydroxide doped with lanthanum as nanocrystalline, nanoporous inorganic compound) and Mitsubishi SG 2575 (containing colloidal silicon dioxide as nanoporous inorganic compound.

Dye Diffusion

The values of coalescence are indicated in Table 5

TABLE 5

| Example | Coalescence |
|---|---|
| 1 | 0 |
| C-2 | 6 |
| C-3 | 0 |

The results in Table 5 clearly show that the recording sheet for ink jet printing according to the invention shows, at the same thickness of the ink-receiving layer, a considerably reduced coalescence in comparison to a recording sheet on a non-porous paper support with a polyethylene layer on both sides. The same value of coalescence on a support having a polyethylene layer on both sides is only obtained when the coating weight of the ink-receiving layer is increased by 46%.

Finally, variations from the examples given herein are possible in view of the above disclosure. Therefore, although the invention has been described with reference to certain preferred embodiments, it will be appreciated that other coating solutions may be devised, which are nevertheless within the scope and spirit of the invention as defined in the claims appended hereto.

The foregoing description of various and preferred embodiments of the present invention has been provided for purposes of illustration only, and it is understood that numerous modifications, variations and alterations may be made without departing from the scope and spirit of the invention as set forth in the following claims.

The invention claimed is:

1. Recording sheet for ink jet printing consisting of a paper support and having coated on the front side of said paper support at least one ink-receiving layer consisting of fumed silicon dioxide with a positively charged surface and at least one binder, wherein the backside of said paper support has been coated with a polyolefin layer; the paper support has a thickness between 100 μm and 250 μm and a thin layer of calcium carbonate on the front thereof and no polyolefin layer between the ink-receiving layer and the front side of the paper support.

2. Recording sheet for ink jet printing according to claim 1, wherein the polyolefin layer consists of high-density polyethylene (HDPE), of low-density polyethylene (LDPE) or a mixture of HDPE and LDPE.

3. Recording sheet for ink jet printing according to claim 2, wherein that the polyolefin layer contains at least 20 percent of LDPE by weight.

4. Recording sheet for ink jet printing according to claim 1, wherein the coating weight of the polyolefin layer is from 5 $g/m^2$ to 30 $g/m^2$.

5. Recording sheet for ink jet printing according to claim 1, wherein the ink-receiving layer has a dry thickness between 10 μm and 25 μm.

6. Recording sheet for ink jet printing according to claim 1, wherein the surface of the fumed silicon dioxide is modified by a treatment with a compound of trivalent aluminum.

7. Recording sheet for ink jet printing according to claim 6, wherein the compound of trivalent aluminum is aluminum chlorohydrate.

8. Recording sheet for ink jet printing according to claim 1, wherein the surface of the fumed silicon dioxide is modified by a treatment with an aminoorganosilane.

9. Recording sheet for ink jet printing according to claim 1, wherein the surface of the fumed silicon dioxide is modified by a treatment with the reaction products of a compound of trivalent aluminum with at least one aminoorganosilane.

10. Recording sheet for ink jet printing according to claim 9, wherein the compound of trivalent aluminum is aluminum chlorohydrate.

* * * * *